US007903131B2

(12) United States Patent
Yamakuni et al.

(10) Patent No.: US 7,903,131 B2
(45) Date of Patent: Mar. 8, 2011

(54) THERMAL TRANSFER PRINTER

(75) Inventors: Minoru Yamakuni, Ise (JP); Kenichi Kawahara, Ise (JP)

(73) Assignee: Shinko Electric Co., Ltd. (JP)

( * ) Notice: Subject to any disclaimer, the term of this patent is extended or adjusted under 35 U.S.C. 154(b) by 533 days.

(21) Appl. No.: 11/989,159

(22) PCT Filed: Jul. 26, 2006

(86) PCT No.: PCT/JP2006/314781

§ 371 (c)(1),
(2), (4) Date: Jan. 22, 2008

(87) PCT Pub. No.: WO2007/013516

PCT Pub. Date: Feb. 1, 2007

(65) Prior Publication Data

US 2010/0118101 A1 May 13, 2010

(30) Foreign Application Priority Data

Jul. 26, 2005 (JP) ..... 2005-215902

(51) Int. Cl.
*B41J 2/00* (2006.01)

(52) U.S. Cl. ..... 347/188

(58) Field of Classification Search ..... None
See application file for complete search history.

(56) References Cited

U.S. PATENT DOCUMENTS 4,870,428 A * 9/1989 Kuwabara et al. ..... 347/195

FOREIGN PATENT DOCUMENTS

| | | | |
|---|---|---|---|
| JP | 07-125293 | A | 5/1995 |
| JP | 08-197762 | A | 8/1996 |
| JP | 10-058732 | A | 3/1998 |

* cited by examiner

*Primary Examiner* — Stephen D Meier
*Assistant Examiner* — Alexander C Witkowski
(74) *Attorney, Agent, or Firm* — Harness, Dickey & Pierce, P.L.C.

(57) ABSTRACT

A thermal transfer printer includes: an ink ribbon conveyor unit that conveys an ink ribbon; a sheet conveyor unit that conveys a sheet; a dummy pattern generation unit that generates a dummy pattern; an image data generation unit that generates print image data joining n screens together, the print image data including the dummy pattern inserted between two adjacent screens among the n screens; a thermal head that transfers a dye coated on the ink ribbon in accordance with the print image data; and a peeler unit that peels the ink ribbon from the sheet. An average density of the dummy pattern is equal to an average density of the image over an area equivalent to a distance between a tail end portion of the thermal head and the peeler unit, on one screen that follows the dummy pattern.

4 Claims, 3 Drawing Sheets

THERMAL TRANSFER PRINTER

BACKGROUND

1. Technical Field

The present invention relates to a thermal transfer printer, and particularly to a technique to suppress lateral banding from occurring in a thermal transfer printer that performs multi-screen printing such as two-screen printing or three-screen printing.

2. Related Art

In a thermal transfer printer, such as a dye sublimation printer, it is preferable to use an ink ribbon having an optimal length for a given print size. For example, to print images having sizes of 6×4 inches and 6×8 inches, it is preferable to use dedicated ink ribbons for the respective sizes. There is known a technique for performing two-screen printing by which consumption of materials and a printing time are reduced. In the known technique, an ink ribbon having a size of, for example, 6×8 inches may be used to perform two-screen printing of two images each having a size of 6×4 inches, in a single process. There is also known a technique of performing three-screen printing by using an ink ribbon having a size of 8×12 inches to perform three-screen printing of three images each having a size of 8×4 inches, in a single process.

FIG. 1 shows a structure of an image forming unit in a thermal transfer printer. Dye that is coated on an ink ribbon 120 is heated by a thermal head 130 and transferred onto a print sheet 141. The ink ribbon 120 and the print sheet 141 after completion of the transfer are separated from one another by a peeler plate 131. A load necessary to effect peeling (hereinafter, "peel force") of the ink ribbon 120 from the print sheet 141 varies depending on an image to be printed. In general, a higher a density of an image to be printed, a greater a peel force required.

In a case of printing plural screens, as noted above, a roll sheet is used and printing is carried out such that a blank space is provided between adjacent screens so that a printed screen is not influenced by another screen. This blank space is cut out finally upon completion of printing, and as a print result only the printed screens are output. In this case, no images are printed on the blank space, and therefore a peel force at the blank space varies greatly from that at other parts where images are formed. This kind of variation in peel force (hereinafter "load variation") causes a tension of the ink ribbon 120 to vary. Such variation in tension of the ink ribbon 120 results in lateral banding in printed images.

Techniques for preventing lateral banding are described in, for example, Patent documents 1 and 2. Patent document 1 discloses a technique for preventing lateral banding by increasing a tension of an ink ribbon; and Patent document 2 discloses a technique for applying a bias energy to a blank space in an ink ribbon (e.g., energy at a level which does not give rise to coloring) so as to prevent lateral banding.

Patent document 1: JP-A-8-197762

Patent document 2: JP-A-7-125293

SUMMARY

The technique disclosed in Patent document 1 is effective for a thermal transfer printer which carries out single-screen printing. However, this technique has a problem that further load variation is caused if a tension is raised between screens in another thermal transfer printer which carries out multi-screen printing. Meanwhile, according to the other technique of applying bias energy, as described in Patent document 2, no sufficient effects to suppress lateral banding are obtained.

The present invention has been made in view of the circumstances as described above and provides a thermal transfer printer capable of performing multi-screen printing while suppressing lateral banding.

To address the problems noted above, according to an embodiment of the present invention, there is provided a thermal transfer printer including: an ink ribbon conveyor unit that conveys an ink ribbon with a dye coated thereon in a layout corresponding to image formation of an a×b size; a sheet conveyor unit that conveys a sheet compatible with the image formation of the a×b size; a dummy pattern generation unit that generates a dummy pattern; an image data generation unit that generates print image data joining n screens together, the n screens each having 1/n size of the a×b size (where n is an integer not smaller than 2), and the print image data including the dummy pattern generated by the dummy pattern generation unit and inserted between two screens among the n screens, one of the two screens being adjacent to the other one along a sheet conveying direction of the sheet conveyor unit; a thermal head that transfers the dye coated on the ink ribbon conveyed by the ink ribbon conveyor unit to the sheet conveyed by the sheet conveyor unit in accordance with the print image data generated by the image data generation unit; and a peeler unit that peels the ink ribbon from the sheet to which an image has been transferred by the thermal head, wherein an average density of the dummy pattern generated by the dummy pattern generation unit is equal to an average density of the image over an area equivalent to a distance between a tail end portion of the thermal head and the peeler unit, on one of the n screens that follows the dummy pattern.

The thermal transfer printer is preferably configured such that a density of the dummy pattern is uniform in the sheet conveying direction of the sheet conveyor unit.

Alternatively, the thermal transfer printer may also preferably be configured such that a density of the dummy pattern periodically changes in the sheet conveying direction of the sheet conveyor unit. This thermal transfer printer may also further preferably be configured such that a density of the dummy pattern changes in the form of a sine wave or saw tooth wave in the sheet conveying direction of the sheet conveyor unit.

BRIEF DESCRIPTION OF THE DRAWINGS

An embodiment of the present invention will now be described in detail with reference to the following figures wherein.

DETAILED DESCRIPTION

An embodiment of the present invention will now be described with reference to the drawings.

Figure 1:
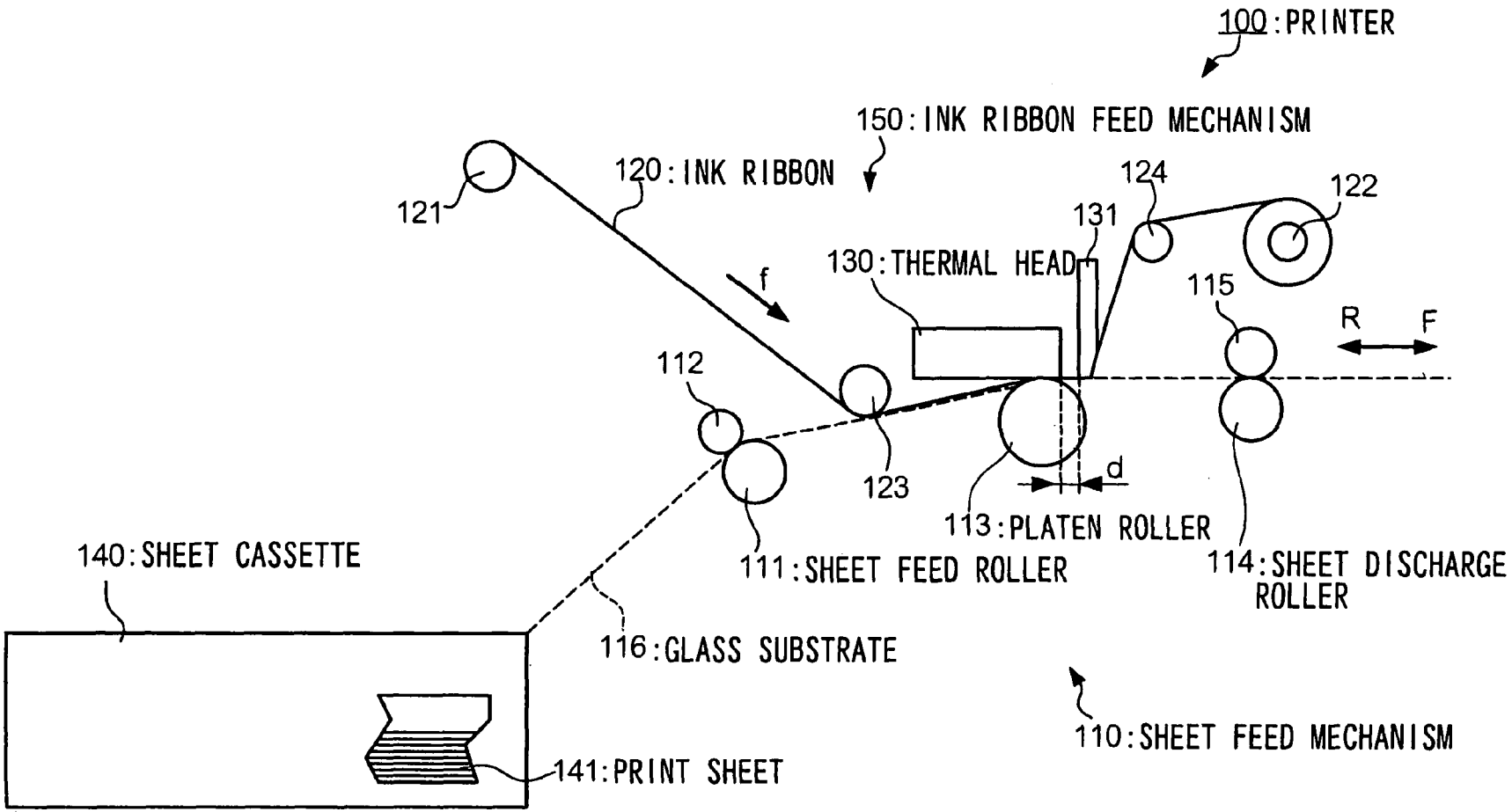
FIG. 1 shows a structure of an image forming unit in a thermal transfer printer.

FIG. 1 shows a structure of a thermal transfer printer 100 according to an embodiment of the present invention. This thermal transfer printer 100 substantially includes a sheet feed mechanism 110, an ink ribbon 120, an ink ribbon feed mechanism 150, a thermal head 130, and a sheet cassette 140.

The thermal transfer printer 100 is driven in accordance with image data from a personal computer, not shown, (hereinafter, "PC"). The thermal transfer printer 100 may be constructed so as to include a memory card interface which reads out image data from a memory card or the like, and may be driven in accordance with the image data read out.

The sheet feed mechanism 110 is sectioned into two sides by the thermal head 130 as a boundary therebetween, i.e., a sheet feed side and a sheet discharge side. The sheet feed mechanism 110 includes a sheet feed roller 111, a pinch roller 112, a platen roller 113, a sheet discharge roller 114, and another pinch roller 115. The sheet feed roller 111 and the pinch roller 112 are located in the sheet feed side. The platen roller 113 is located at a position where the roller 113 faces the thermal head 130. The color filter 114 and pinch roller 115 are located in the sheet discharge side. The sheet feed mechanism 110 conveys a print sheet 141 between the sheet feed roller 111 and the pinch roller 112, between the thermal head 130 and the platen roller 113, and further between the sheet discharge filter 114 and the pinch roller 115, sequentially.

The sheet feed roller 111, platen roller 113, and sheet discharge filter 114 are driven to rotate by a drive device (not shown in the figures) such as a stepping motor, for example. When this drive device is driven to rotate the sheet feed roller 111, platen roller 113, and sheet discharge filter 114 in a clockwise direction, the print sheet 141 is conveyed in a feed direction F. On the other side, when these rollers are rotated in an anti-clockwise direction, the print sheet 141 is conveyed in a return direction R.

The ink ribbon feed mechanism 150 conveys the ink ribbon 120 from a roller 121 in the feed side to a winder roller 122. Two ends of the ink ribbon 120 are wound about the feeder roller 121 and the winder roller 122, respectively. The winder roller 122 is rotated in a clockwise direction by a drive device (not shown in the figures) such as a DC motor, to wind up the ink ribbon 120. As a result, the ink ribbon 120 is conveyed in the feed direction f.

Figure 2:
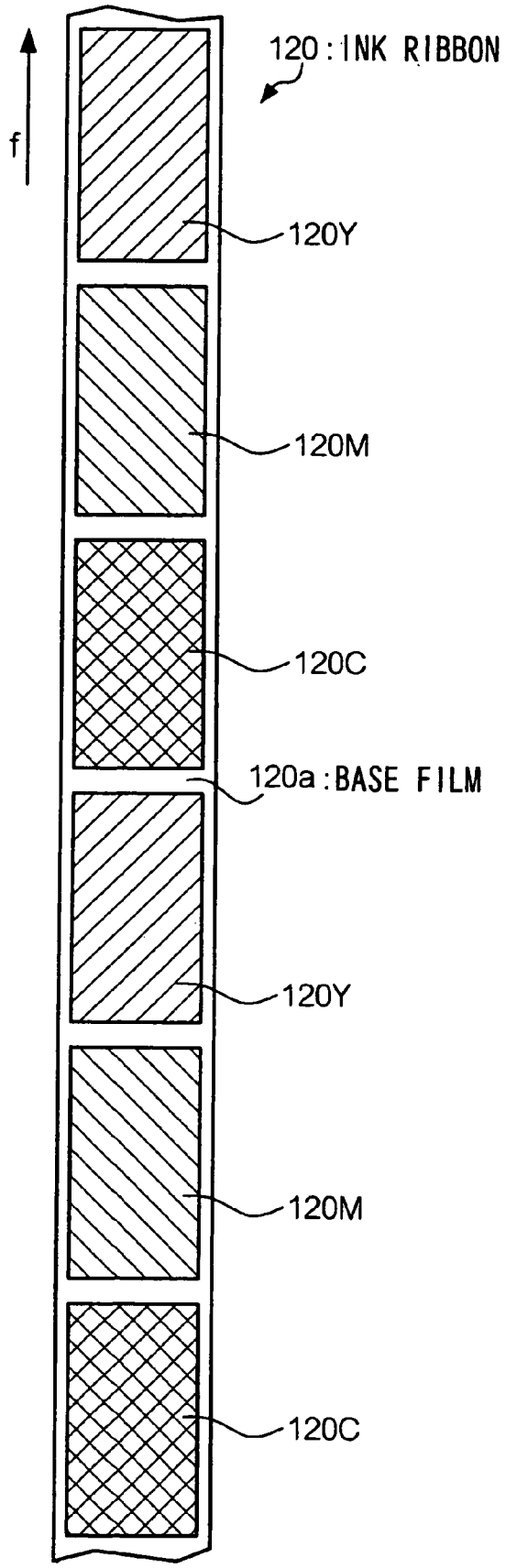
FIG. 2 shows a structure of an ink ribbon 120.

FIG. 2 shows structure of the ink ribbon 120. The ink ribbon 120 is constituted of a thin base film 120*a* and dye layers 120Y, 120M, and 120C. The dye layers are formed by repeatedly coating dyes of Y (yellow), M (magenta), and C (cyan), in that order, in the lengthwise direction of the base film 120*a*.

Further description will now be made referring again to FIG. 1. In the present embodiment, dyes that may be thermally sublimated are used for the ink ribbon 120. In the external sensor terminal 100 using the ink ribbon 120, print density levels are changed by temperature adjustment of thermal head 130, and thus, tone printing may be performed. As a result, high-quality color images are formed on a print sheet 141.

Like the sheet feed mechanism 110, the ink ribbon 120 is sectioned into two sides by the thermal head 130 as a boundary therebetween, i.e., a feed side and a discharge side. A guide roller 123 in the feed side is located between the thermal head 130 and the feeder roller 121, as well as another guide roller 124 in the discharge side between the thermal head 130 and the winder roller 122.

The thermal head 130 is constructed by arraying plural heating elements (not shown in the figures) on a board. The thermal head 130 is moved apart from and pressed towards to contact the platen roller 113 by an elevation mechanism not shown. The peeler plate 131 is provided near the thermal head 130. The peeler plate 131 is provided in one side of the thermal head 130 to which the feed direction F extends. The peeler plate 131 is brought into contact from above with the ink ribbon 120 which has already transferred dyes to the print sheet 141. In this manner, the peeler plate 131 changes the conveying course of the ink ribbon 120 so that it deviates from the conveying course of the print sheet. In other words, the ink ribbon 120 is peeled off from the print sheet about the peeler plate 131 which acts as a fulcrum.

The sheet cassette 140 contains a large number of print sheets 141 having a fixed size (e.g., JIS A4, A5, etc.). One after another, print sheets 141 are picked up by a sheet feeder not shown and conveyed through a sheet conveying path 116. Onto a print sheet 141 thus conveyed, dyes of respective colors are transferred within an image forming area between the thermal head 130 and the platen roller 113.

Figure 3:
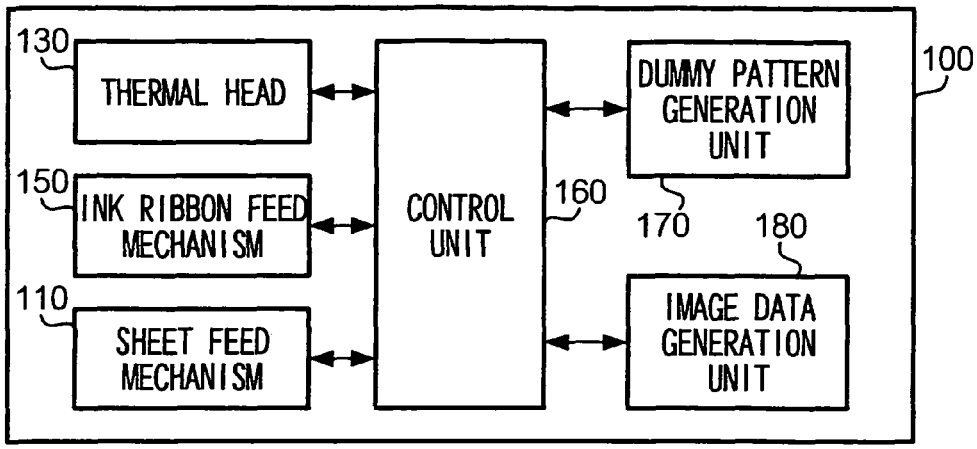
FIG. 3 is a diagram showing a configuration of functions of the thermal transfer printer 100.

FIG. 3 is a diagram showing a configuration of functions of the thermal transfer printer 100. The sheet feed mechanism 110 and the ink ribbon feed mechanism 150 have already described above with reference to FIG. 1. A dummy pattern generation unit 170 generates a dummy pattern, which will be described in detail later. An image data generation unit 180 generates print image data to drive the thermal head 130. A control unit 160, the dummy pattern generation unit 170, and the image data generation unit 180 may be configured such that a processor such as a CPU executes a program to realize functions thereof. Alternatively, circuits respectively dedicated to these functions may be used.

The following describes operation of the thermal transfer printer 100, exemplifying a case of performing two-screen printing to print out images each having a 6×4 inch size by use of an ink ribbon having a 6×8 inch size.

Figure 4:
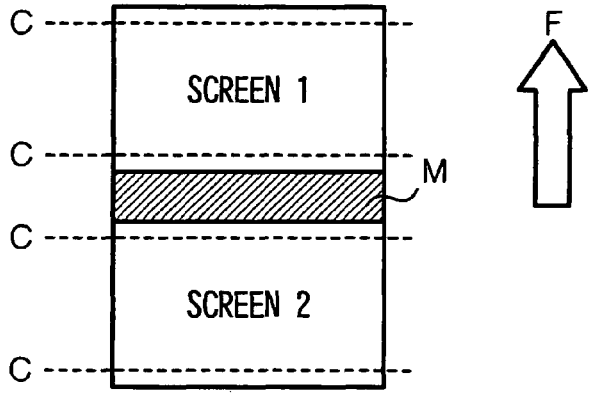
FIG. 4 shows a structure of image data in two-screen printing.

FIG. 4 shows a structure of image data in two-screen printing. In this case, two screens 1 and 2 are printed on one print sheet 141 through one process. A blank space M is provided between the two screens so that no blank space might appear at edge parts of each screen and that each screen might not influence the other screen. The image data generation unit 180 inserts a dummy pattern generated by the dummy pattern generation unit 170 into the blank space M. The print sheet 141 is cut along a cutoff line at the position C in FIG. 4 by a cutting mechanism (not shown in the figures). In FIG. 4, the symbol F denotes the conveying direction of the print sheet 141.

The dummy pattern generation unit 170 generates a dummy pattern in the fashion described below. The dummy pattern generation unit 170 calculates an average density of each color of C, M, and Y over an area equivalent to the distance (d in FIG. 1) between the tail end of the thermal head 130 and the peeler plate 131, on the screen following the dummy pattern. The dummy pattern generation unit 170 generates a dummy pattern as to have average densities equal to the calculated average densities over the area noted above.

Figure 5A:
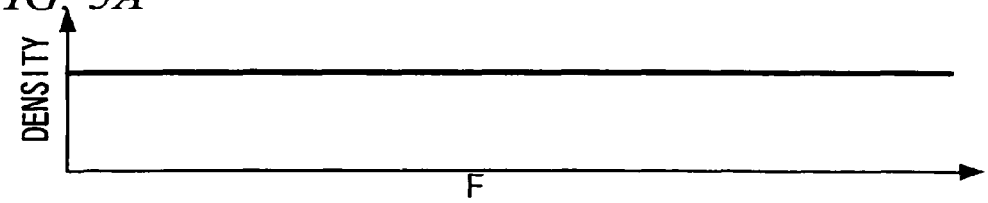
FIGS. 5A-5C are graphs exemplifying dummy patterns.
Figure 5B:
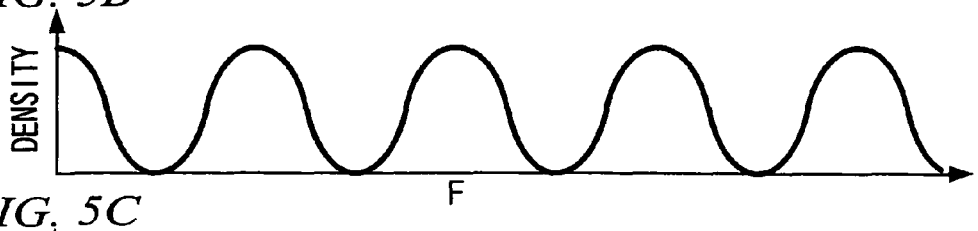
Figure 5C:
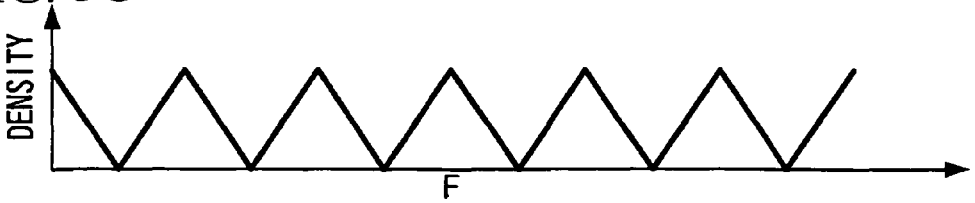

FIGS. 5A to 5C are graphs exemplifying dummy patterns. As shown in FIG. 5A, a dummy pattern may have a uniform density in the conveying direction F of the print sheet 141. Alternatively, as shown in FIG. 5B or 5C, another dummy pattern may have a density which changes periodically. FIG. 5B shows a pattern a density of which changes in the form of a sine wave. FIG. 5C shows a pattern a density of which changes in the form of a saw tooth wave. Thus, a dummy pattern is printed on the blank space M, and a load variation may thereby be suppressed, i.e., lateral banding may be suppressed. Particularly when using a periodic pattern, as shown in FIG. 5B or 5C, a load variation may be reduced if a pattern to be printed is made periodic.

As has been described above, the thermal transfer printer 100 according to the present embodiment is capable of performing multi-screen printing while suppressing lateral banding. The thermal transfer printer 100 is not limited only to performing two-screen printing but may be configured to perform n-screen printing (where n is an integer not smaller than two). For example, where n=6, a screen may be arrayed in a matrix layout of three rows×two columns. In this case, a dummy pattern may be inserted between each adjacent screen in the conveying direction of the print sheet 141.

What is claimed is:

1. A thermal transfer printer, comprising:

an ink ribbon conveyor unit configured to convey an ink ribbon with a dye coated thereon in a layout corresponding to image formation of an a×b size;

a sheet conveyor unit configured to convey a sheet compatible with the image formation of the a×b size;

a dummy pattern generation unit configured to generate a dummy pattern;

an image data generation unit configured to generate print image data joining n screens together, the n screens each having 1/n size of the a×b size (where n is an integer not smaller than 2), and the print image data including the dummy pattern generated by the dummy pattern generation unit and inserted between two screens among the n screens, one of the two screens being adjacent to the other one along a sheet conveying direction of the sheet conveyor unit;

a thermal head configured to transfer the dye coated on the ink ribbon conveyed by the ink ribbon conveyor unit to the sheet conveyed by the sheet conveyor unit in accordance with the print image data generated by the image data generation unit; and a peeler unit configured to peel the ink ribbon from the sheet to which an image has been transferred by the thermal head, wherein an average density of the dummy pattern generated by the dummy pattern generation unit is equal to an average density of the image over an area equivalent to a distance between a tail end portion of the thermal head and the peeler unit, on one of the n screens that follows the dummy pattern.

2. The thermal transfer printer according to claim 1, wherein a density of the dummy pattern is uniform in the sheet conveying direction of the sheet conveyor unit.

3. The thermal transfer printer according to claim 1, wherein a density of the dummy pattern periodically changes in the sheet conveying direction of the sheet conveyor unit.

4. The thermal transfer printer according to claim 3, wherein a density of the dummy pattern changes in the form of a sine wave or saw tooth wave in the sheet conveying direction of the sheet conveyor unit.

* * * * *